US012404866B1

(12) United States Patent
Yokoi et al.

(10) Patent No.: US 12,404,866 B1
(45) Date of Patent: Sep. 2, 2025

(54) CENTRIFUGAL COMPRESSOR

(71) Applicant: KABUSHIKI KAISHA TOYOTA JIDOSHOKKI, Kariya (JP)

(72) Inventors: Yuki Yokoi, Kariya (JP); Naoki Koeda, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/908,149

(22) Filed: Oct. 7, 2024

(30) Foreign Application Priority Data

Jun. 6, 2024 (JP) ..... 2024-092251

(51) Int. Cl.

| | |
|---|---|
| ***F04D 25/06*** | (2006.01) |
| ***F04D 1/00*** | (2006.01) |
| ***F04D 1/04*** | (2006.01) |
| ***F04D 13/06*** | (2006.01) |
| ***F04D 17/08*** | (2006.01) |
| ***F04D 17/10*** | (2006.01) |
| ***F04D 29/28*** | (2006.01) |
| ***F04D 29/44*** | (2006.01) |

(52) U.S. Cl.

CPC ..... *F04D 25/0693* (2013.01); *F04D 17/10* (2013.01); *F04D 29/441* (2013.01); *F04D 1/006* (2013.01); *F04D 1/04* (2013.01); *F04D 13/06* (2013.01); *F04D 17/08* (2013.01); *F04D 25/06* (2013.01); *F04D 25/0606* (2013.01); *F04D 25/068* (2013.01); *F04D 29/28* (2013.01); *F04D 29/283* (2013.01)

(58) Field of Classification Search
CPC combination set(s) only.
See application file for complete search history.

(56) References Cited

U.S. PATENT DOCUMENTS

| | | | | |
|---|---|---|---|---|
| 2004/0109772 | A1 | 6/2004 | Ogawa et al. | |
| 2012/0308414 | A1 | 12/2012 | Ogawa et al. | |
| 2014/0294628 | A1* | 10/2014 | Yano | F04C 18/0215 417/410.5 |

(Continued)

FOREIGN PATENT DOCUMENTS

| | | |
|---|---|---|
| JP | 3-111700 A | 5/1991 |
| JP | 2010-48146 A | 3/2010 |

(Continued)

OTHER PUBLICATIONS

German Office Action dated May 27, 2025 in Application No. 10-2024125776.8.

*Primary Examiner* — Binh Q Tran
(74) *Attorney, Agent, or Firm* — Sughrue Mion, PLLC

(57) ABSTRACT

A centrifugal compressor includes a rotary shaft, a compression mechanism that compresses fluid, a motor, an inverter, a housing, and a wiring unit. The compression mechanism includes an impeller, a suction chamber, a diffuser, and a volute. The housing has a motor housing member, an impeller housing member, a suction housing member, and an inverter housing member. The housing has a through hole that extends to an inside of the inverter housing member from the motor housing member. The wiring unit is disposed in the housing and inserted in the through hole. The through hole is disposed away from the volute. A suction passage is located away from the through hole in a circumferential direction of the rotary shaft.

5 Claims, 4 Drawing Sheets

(56) References Cited

U.S. PATENT DOCUMENTS

| | | | | |
|---|---|---|---|---|
| 2015/0044075 | A1 | 2/2015 | Abe et al. | |
| 2015/0267707 | A1 | 9/2015 | Hoshino et al. | |
| 2016/0245292 | A1* | 8/2016 | Kawasaki | F04C 23/008 |
| 2017/0274728 | A1* | 9/2017 | Suzuki | B60L 58/33 |
| 2019/0055954 | A1* | 2/2019 | Egawa | F04D 29/057 |
| 2019/0226486 | A1* | 7/2019 | Iizuka | F02B 39/00 |
| 2023/0107796 | A1* | 4/2023 | Takimoto | H02K 5/04 417/423.7 |
| 2023/0110735 | A1* | 4/2023 | Akiyama | F04D 27/0261 417/423.8 |
| 2023/0283141 | A1* | 9/2023 | Okuma | F04D 25/0693 417/423.7 |

FOREIGN PATENT DOCUMENTS

| | | | |
|---|---|---|---|
| JP | 2015-194151 | A | 11/2015 |
| JP | 2023-68922 | A | 5/2023 |

* cited by examiner

CENTRIFUGAL COMPRESSOR

CROSS-REFERENCE TO RELATED APPLICATION

This application claims priority to Japanese Patent Application No. 2024-092251 filed on Jun. 6, 2024, the entire disclosure of which is incorporated herein by reference.

BACKGROUND ART

The present disclosure relates to a centrifugal compressor.

The centrifugal compressor includes a rotary shaft, a compression mechanism, a motor, an inverter, and a housing. The compression mechanism compresses fluid with rotation of the rotary shaft. The motor rotates the rotary shaft. The inverter drives the motor. The motor, the compression mechanism, and the inverter are arranged in this order in an axial direction of the rotary shaft and accommodated in the housing. The compression mechanism has an impeller, a suction chamber, a diffuser, and a volute. The impeller rotates integrally with the rotary shaft. The diffuser is disposed downstream of the impeller in a direction in which the fluid flows. The volute communicates with an outlet of the diffuser and is located outward with respect to the diffuser in a radial direction of the rotary shaft.

The suction chamber may be located closer to the inverter than the impeller 25 in the axial direction of the rotary shaft. As such, when the suction chamber may be located closer to the inverter than the impeller in the axial direction of the rotary shaft, heat generated from the inverter is dissipated to the fluid in the suction chamber. As a result, the inverter is efficiently cooled by the fluid in the suction chamber. In addition, the centrifugal compressor includes a wiring unit electrically connecting the motor to the inverter. For example, in Japanese Patent Application Publication No. H03-111700, a part of the wiring unit extends outside the housing.

As seen in the Publication, when the wiring unit extends outside the housing, a sealing member may be required between the wiring unit and the housing, and the wiring unit may need to be fixed to the housing such that the wiring unit does not interfere with auxiliary equipment, or the like disposed around the centrifugal compressor. These may increase the number of components of the centrifugal compressor and reduce ease of installation of the centrifugal compressor. Accordingly, it is desired to electrically connect the motor to the inverter without increasing the number of components of the centrifugal compressor and reducing the ease of installation of the centrifugal compressor while the centrifugal compressor is prevented from increasing in size.

SUMMARY

In accordance with an aspect of the present disclosure, there is provided a centrifugal compressor that includes a rotary shaft, a compression mechanism that compresses fluid with rotation of the rotary shaft, a motor that rotates the rotary shaft, an inverter that drives the motor, a housing in which the motor, the compression mechanism, and the inverter arranged in this order in an axial direction of the rotary shaft are accommodated, and a wiring unit through which the motor and the inverter are electrically connected to each other. The compression mechanism includes an impeller that rotates integrally with the rotary shaft, a suction chamber that is located closer to the inverter than the impeller in the axial direction, a diffuser that is disposed downstream of the impeller in a direction in which the fluid flows, and a volute that communicates with an outlet of the diffuser and is located outward with respect to the diffuser in a radial direction of the rotary shaft. The housing has a motor housing member in which the motor is accommodated, an impeller housing member in which the impeller is accommodated and that define the diffuser and the volute, a suction housing member that defines the suction chamber, and an inverter housing member in which the inverter is accommodated. The motor housing member, the impeller housing member, the suction housing member, and the inverter housing member are arranged in this order in the axial direction. The housing has a through hole that extends in the axial direction to an inside of the inverter housing member from the motor housing member through the impeller housing member and the suction housing member. The wiring unit is disposed in the housing and inserted in the through hole. The through hole is disposed away from the volute. A suction passage through which the suction chamber is connected to an outside of the housing is located away from the through hole in a circumferential direction of the rotary shaft.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe an embodiment of a centrifugal compressor according to the present disclosure with reference to FIGS. 1 to 4. The centrifugal compressor of the present embodiment is mounted on a vehicle, which is not illustrated, and used in a refrigerating cycle of a vehicle air conditioner. The centrifugal compressor compresses a refrigerant as fluid.

<Basic Configuration of Centrifugal Compressor>

Figure 1:
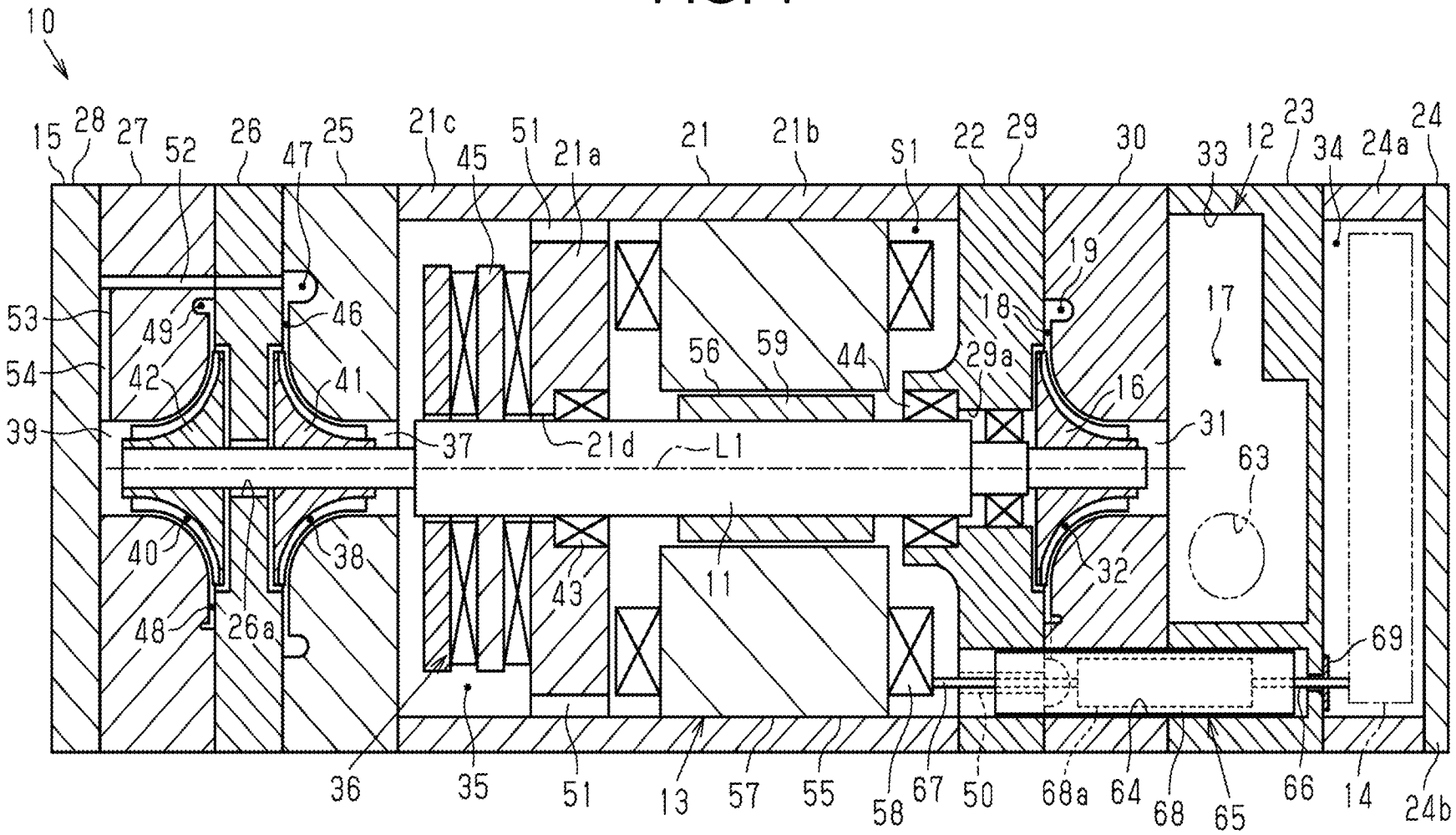
FIG. 1 is a cross-sectional view illustrating a centrifugal compressor according to an embodiment.

As illustrated in FIG. 1, a centrifugal compressor 10 includes a rotary shaft 11, a compression mechanism 12, a motor 13, an inverter 14, and a housing 15. The compression mechanism 12 has a first impeller 16 as the impeller, a suction chamber 17, a first diffuser 18 as the diffuser, and a first volute 19 as the volute. The compression mechanism 12 compresses a refrigerant with rotation of the rotary shaft 11. The motor 13 rotates the rotary shaft 11. The inverter 14 drives the motor 13.

The housing 15 is formed in a tubular shape. The housing 15 has a motor housing member 21, an impeller housing member 22, a suction housing member 23, and an inverter housing member 24. The housing 15 also has a first plate 25, a second plate 26, a third plate 27, and a fourth plate 28. The motor housing member 21, the impeller housing member 22, the suction housing member 23, the inverter housing member 24, the first plate 25, the second plate 26, the third plate 27, and the fourth plate 28 are made of a metal material, for example, aluminum.

The motor housing member 21 has an end wall 21*a* formed in a plate shape, a first peripheral wall 21*b* formed in a tubular shape, and a second peripheral wall 21*c* formed in a tubular shape. The end wall 21*a* has a shaft insertion hole 21*d* formed in a circular hole shape. The shaft insertion hole 21*d* is formed in a center portion of the end wall 21*a*. The shaft insertion hole 21*d* extends through the end wall 21*a* in a thickness direction of the end wall 21*a*. The first peripheral wall 21*b* extends from an outer peripheral portion of one surface of the end wall 21*a* in the thickness direction of the end wall 21*a*. The second peripheral wall 21*c* extends from an outer peripheral portion of the other surface of the end wall 21*a* in the thickness direction of the end wall 21*a*.

Figure 2:
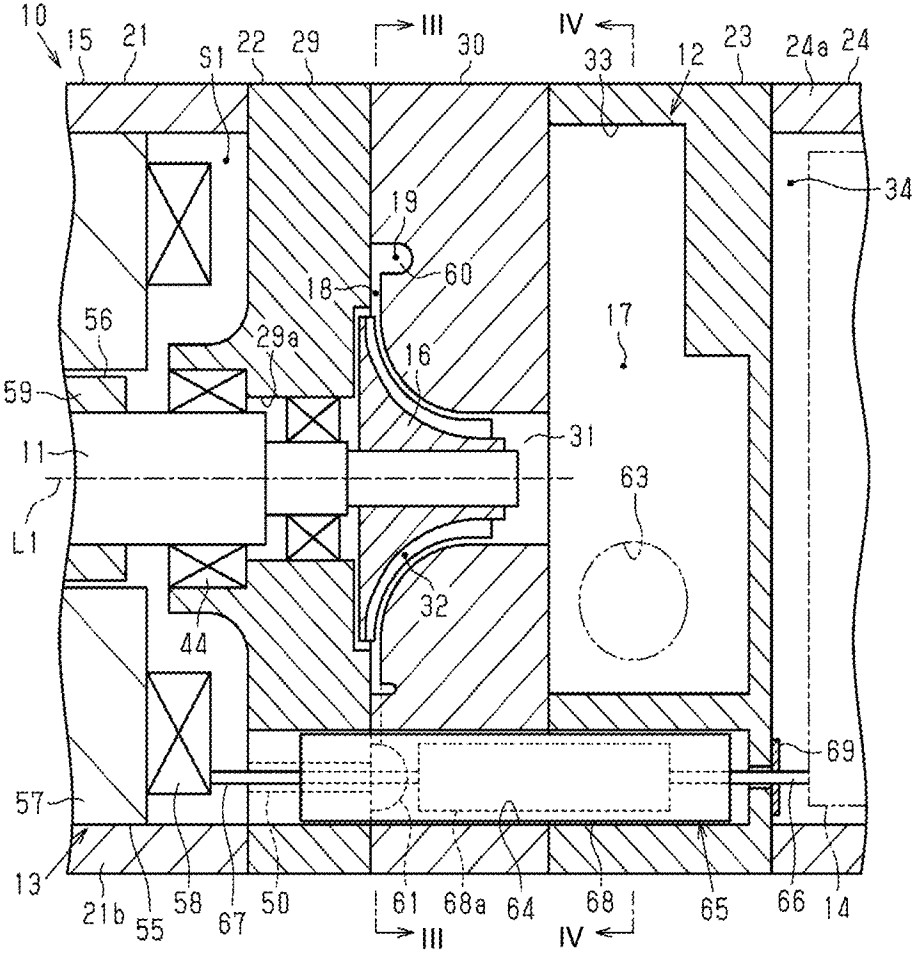
FIG. 2 is an enlarged cross-sectional view of a part of the centrifugal compressor.

As illustrated in FIG. 2, the impeller housing member 22 has a first housing member 29 and a second housing member 30. The first housing member 29 is formed in a plate shape. The first housing member 29 is connected to the motor housing member 21 while closing an opening of the first peripheral wall 21*b*. The end wall 21*a* and the first peripheral wall 21*b* of the motor housing member 21, and the first housing member 29 of the impeller housing member 22 define a motor chamber S1. The motor 13 is accommodated in the motor chamber S1. That is, the motor 13 is accommodated in the motor housing member 21.

The first housing member 29 has a shaft insertion hole 29*a* formed in a circular hole shape. The shaft insertion hole 29*a* is formed in a center portion of the first housing member 29. The shaft insertion hole 29*a* extends through the first housing member 29 in a thickness direction of the first housing member 29. An axial line of the shaft insertion hole 29*a* is aligned with an axial line of the shaft insertion hole 21*d*.

The second housing member 30 is formed in a plate shape. The second housing member 30 is connected to an end surface of the first housing member 29 with the first housing member 29 interposed between the second housing member 30 and the motor housing member 21. The second housing member 30 is connected to the first housing member 29 with a thickness direction of the second housing member 30 coinciding with the thickness direction of the first housing member 29.

The second housing member 30 has a first suction port 31 formed in a circular hole shape. The first suction port 31 is formed in a center portion of the second housing member 30. The first suction port 31 is opened in one end surface of the second housing member 30, which is opposite to the other end surface of the second housing member 30 facing the first housing member 29. The second housing member 30 is connected to the first housing member 29 with an axial line of the first suction port 31 aligned with the axial line of the shaft insertion hole 29*a*.

A first impeller chamber 32 is formed inside the first housing member 29 and the second housing member 30. Accordingly, the first housing member 29 and the second housing member 30 define the first impeller chamber 32. The first impeller chamber 32 communicates with the first suction port 31. The first impeller 16 is accommodated in the first impeller chamber 32. That is, the first impeller 16 is accommodated in the impeller housing member 22.

The suction housing member 23 is connected to the end surface of the second housing member 30 with the second housing member 30 interposed between the first housing member 29 and the suction housing member 23. The suction housing member 23 has a chamber forming recess 33. The chamber forming recess 33 is opened in an end surface of the suction housing member 23 near the second housing member 30. The second housing member 30 closes the opening of the chamber forming recess 33. The chamber forming recess 33 and the second housing member 30 define the suction chamber 17. That is, the suction housing member 23 defines the suction chamber 17. The suction chamber 17 communicates with the first suction port 31.

As illustrated in FIG. 1, the inverter housing member 24 has a housing main body 24*a* and a covering member 24*b*. The housing main body 24*a* is formed in a tubular shape. The housing main body 24*a* is connected to an end surface of the suction housing member 23 with the suction housing member 23 interposed between the second housing member 30 and the housing main body 24*a*. An opening of the housing main body 24*a* at a first end thereof is closed by the one end surface of the suction housing member 23, which is opposite to the other end surface of the suction housing member 23 facing the second housing member 30. The covering member 24*b* is connected to the housing main body 24*a* while closing an opening of the housing main body 24*a* at a second end thereof. The housing main body 24*a*, the covering member 24*b*, and the suction housing member 23 define an inverter chamber 34. The inverter 14 is accommodated in the inverter chamber 34. That is, the inverter 14 is accommodated in the inverter housing member 24.

The first plate 25 is connected to the motor housing member 21 while closing an opening of the second peripheral wall 21*c* of the motor housing member 21. The end wall 21*a* and the second peripheral wall 21*c* of the motor housing member 21, and the first plate 25 define a bearing accommodating chamber 35. The bearing accommodating chamber 35 communicates with the shaft insertion hole 21*d*. A thrust bearing 36 is accommodated in the bearing accommodating chamber 35.

The first plate 25 has a second suction port 37 formed in a circular hole shape. The second suction port 37 is formed in a center portion of the first plate 25. The second suction port 37 is opened in an end surface of the first plate 25 near the motor housing member 21. The first plate 25 is connected to the motor housing member 21 with an axial line of the second suction port 37 aligned with the axial line of the shaft insertion hole 21*d*.

The second plate 26 is connected to an end surface of the first plate 25 with the first plate 25 interposed between the motor housing member 21 and the second plate 26. The second plate 26 is connected to the first plate 25 with a thickness direction of the second plate 26 coinciding with a thickness direction of the first plate 25.

The second plate 26 has a shaft insertion hole 26*a*. The shaft insertion hole 26*a* is formed in a center portion of the second plate 26. The shaft insertion hole 26*a* extends through the second plate 26 in the thickness direction of the second plate 26. An axial line of the shaft insertion hole 26*a* is aligned with the axial line of the second suction port 37.

A second impeller chamber 38 is formed inside the first plate 25 and the second plate 26. Thus, the first plate 25 and the second plate 26 define the second impeller chamber 38. The second impeller chamber 38 communicates with the second suction port 37. Furthermore, the second impeller chamber 38 communicates with the shaft insertion hole 26*a*.

The third plate 27 is connected to an end surface of the second plate 26 with the second plate 26 interposed between the first plate 25 and the third plate 27. The third plate 27 is connected to the second plate 26 with a thickness direction of the third plate 27 coinciding with the thickness direction of the second plate 26.

The third plate 27 has a third suction port 39 formed in a circular hole shape. The third suction port 39 is formed in a center portion of the third plate 27. The third suction port 39 is opened in one end surface of the third plate 27, which is opposite to the other end surface of the third plate 27 facing the second plate 26. The third plate 27 is connected to the second plate 26 with an axial line of the third suction port 39 aligned with the axial line of the shaft insertion hole 26*a*.

A third impeller chamber 40 is formed inside the second plate 26 and the third plate 27. Thus, the second plate 26 and the third plate 27 define the third impeller chamber 40. The third impeller chamber 40 communicates with the third suction port 39. Furthermore, the third impeller chamber 40 communicates with the shaft insertion hole 26*a*.

The fourth plate 28 is connected to an end surface of the third plate 27 with the third plate 27 interposed between the second plate 26 and the fourth plate 28. The fourth plate 28 closes the opening of the third suction port 39 in an axial direction of the third suction port 39.

The rotary shaft 11 is accommodated in the housing 15. A first end of the rotary shaft 11 is located in the first impeller chamber 32. The rotary shaft 11 extends through the shaft insertion hole 29*a*, the motor chamber S1, the shaft insertion hole 21*d*, the bearing accommodating chamber 35, the second suction port 37, the second impeller chamber 38, and the shaft insertion hole 26*a*. A second end of the rotary shaft 11 is located in the third impeller chamber 40.

The first impeller 16 is connected to a first end portion of the rotary shaft 11. The centrifugal compressor 10 includes a second impeller 41 and a third impeller 42. The second impeller 41 is accommodated in the second impeller chamber 38. The third impeller 42 is accommodated in the third impeller chamber 40. The second impeller 41 and the third impeller 42 are connected to a second end portion of the rotary shaft 11. The first impeller 16, the second impeller 41, and the third impeller 42 rotate integrally with the rotary shaft 11.

The first impeller 16 rotates integrally with the rotary shaft 11 in order to compress the refrigerant sucked into the first impeller chamber 32 through the first suction port 31. The second impeller 41 rotates integrally with the rotary shaft 11 in order to compress the refrigerant sucked into the second impeller chamber 38 through the second suction port 37. The third impeller 42 rotates integrally with the rotary shaft 11 in order to compress the refrigerant sucked into the third impeller chamber 40 through the third suction port 39.

The motor housing member 21, the impeller housing member 22, the suction housing member 23, and the inverter housing member 24 are arranged in this order in the axial direction of the rotary shaft 11. The motor 13, the compression mechanism 12, and the inverter 14 are arranged in this order in the axial direction of the rotary shaft 11 and accommodated in the housing 15. The suction chamber 17 is located closer to the inverter 14 than the first impeller 16 in the axial direction of the rotary shaft 11.

A first radial bearing 43 is provided between the shaft insertion hole 21*d* and the rotary shaft 11. The first radial bearing 43 rotatably supports the rotary shaft 11 in a radial direction thereof. A second radial bearing 44 is provided between the shaft insertion hole 29*a* and the rotary shaft 11. The second radial bearing 44 rotatably supports the rotary shaft 11 in the radial direction thereof.

The centrifugal compressor 10 includes a thrust collar 45. The thrust collar 45 is formed in a circular plate shape. The thrust collar 45 protrudes from an outer circumferential surface of the rotary shaft 11. The thrust collar 45 is press-fitted into the outer circumferential surface of the rotary shaft 11. The thrust collar 45 rotates integrally with the rotary shaft 11. The thrust collar 45 is disposed in the bearing accommodating chamber 35. The thrust bearing 36 rotatably supports the rotary shaft 11 through the thrust collar 45 in a thrust direction of the rotary shaft 11.

As illustrated in FIG. 2, the first diffuser 18 and the first volute 19 are formed inside the first housing member 29 and the second housing member 30. That is, the impeller housing member 22 defines the first diffuser 18 and the first volute 19. The first diffuser 18 is disposed downstream of the first impeller 16 in a direction in which the refrigerant flows. The first volute 19 extends around the axial line of the first suction port 31 so as to surround the first impeller chamber 32. The first volute 19 communicates with an outlet of the first diffuser 18 and is located outward with respect to the first diffuser 18 in the radial direction of the rotary shaft 11.

As illustrated in FIG. 1, the centrifugal compressor 10 includes a second diffuser 46 and a second volute 47. The second diffuser 46 and the second volute 47 are formed inside the first plate 25 and the second plate 26. Accordingly, the first plate 25 and the second plate 26 define the second diffuser 46 and the second volute 47. The second diffuser 46 is disposed downstream of the second impeller 41 in the direction in which the refrigerant flows. The second volute 47 extends around the axial line of the second suction port 37 so as to surround the second impeller chamber 38. The second volute 47 communicates with an outlet of the second diffuser 46 and is located outward with respect to the second diffuser 46 in the radial direction of the rotary shaft 11.

The centrifugal compressor 10 includes a third diffuser 48 and a third volute 49. The third diffuser 48 and the third volute 49 are formed inside the second plate 26 and the third plate 27. Accordingly, the second plate 26 and the third plate 27 define the third diffuser 48 and the third volute 49. The third diffuser 48 is disposed downstream of the third impeller 42 in the direction in which the refrigerant flows. The third volute 49 extends around the axial line of the third suction port 39 so as to surround the third impeller chamber 40. The third volute 49 communicates with an outlet of the third diffuser 48 and is located outward with respect to the third diffuser 48 in the radial direction of the rotary shaft 11.

The centrifugal compressor 10 has a first communication hole 50. The first communication hole 50 is formed in the first housing member 29. A first end of the first communication hole 50 communicates with the first volute 19. A second end of the first communication hole 50 communicates with the motor chamber S1. The centrifugal compressor 10 has a plurality of second communication holes 51. The second communication holes 51 are formed in the end wall 21*a* of the motor housing member 21. A first end of each of the second communication holes 51 communicates with the motor chamber S1. A second end of each of the second communication holes 51 communicates with the bearing accommodating chamber 35.

The centrifugal compressor 10 has a third communication hole 52. The third communication hole 52 extends through the second plate 26 and the third plate 27. A first end of the third communication hole 52 communicates with the second volute 47. The third communication hole 52 is, at a second end thereof, opened in the one end surface of the third plate 27, which is opposite to the other end surface of the third plate 27 facing the second plate 26. The centrifugal compressor 10 has a communication groove 53. The communication groove 53 is formed in the one end surface of the third plate 27, which is opposite to the other end surface of the third plate 27 facing the second plate 26. The communication groove 53 extends in the radial direction of the rotary shaft 11. The communication groove 53 is closed by the fourth plate 28. The communication groove 53 and the fourth plate 28 define a communication passage 54. A first end of the communication passage 54 communicates with the second end of the third communication hole 52. A second end of the communication passage 54 communicates with the third suction port 39.

The motor 13 includes a stator 55 and a rotor 56. The stator 55 has a stator core 57 formed in a cylindrical shape and a coil 58 wound around the stator core 57. The stator core 57 is fixed to an inner peripheral surface of the first peripheral wall 21*b* of the motor housing member 21. The rotor 56 is disposed inside the stator core 57 in the motor chamber S1. The rotor 56 rotates integrally with the rotary shaft 11. The rotor 56 has a rotor core 59 fixed to the rotary shaft 11 and a plurality of permanent magnets provided in the rotor core 59. Illustrations of the permanent magnets are omitted.

<First Volute>

Figure 3:
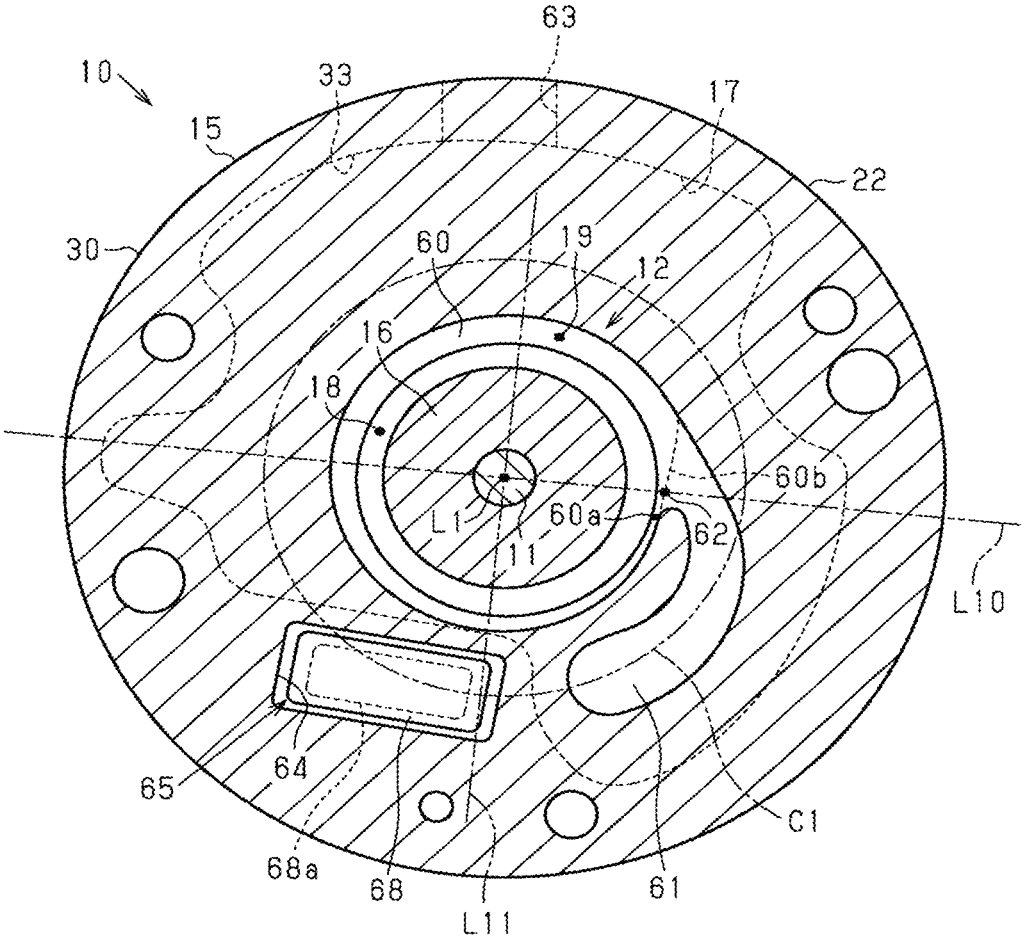
FIG. 3 is a cross-sectional view taken along a line III-III of FIG. 2.

As illustrated in FIG. 3, the first volute 19 has a scroll passage 60 and a discharge passage 61. The scroll passage 60 extends spirally around an axial line L1 of the rotary shaft 11 in a circumferential direction of the rotary shaft 11. The scroll passage 60 communicates with the outlet of the first diffuser 18. The scroll passage 60 surrounds the first diffuser 18. The scroll passage 60 is located outward with respect to the first diffuser 18 in the radial direction of the rotary shaft 11 and extends over an entire length of the rotary shaft 11 in the circumferential direction thereof. The scroll passage 60 has a minimum scroll passage portion 60*a* and a maximum scroll passage portion 60*b*. The minimum scroll passage portion 60*a* is a portion having the minimum cross-sectional area of the scroll passage 60 and the maximum scroll passage portion 60*b* is a portion having the maximum cross-sectional area of the scroll passage 60. The cross-sectional area of the scroll passage 60 gradually increases as the scroll passage 60 extends in the circumferential direction of the rotary shaft 11 from the minimum scroll passage portion 60*a* and reaches the cross-sectional area of the maximum scroll passage portion 60*b*. The minimum scroll passage portion 60*a* and the maximum scroll passage portion 60*b* communicate with each other.

The discharge passage 61 branches off from the scroll passage 60. The discharge passage 61 is located outward with respect to the scroll passage 60 in the radial direction of the rotary shaft 11 and extends around the axial line L1 of the rotary shaft 11 in the circumferential direction of the rotary shaft 11. The discharge passage 61 branches off from the maximum scroll passage portion 60*b* of the scroll passage 60. Thus, a connecting point at which the discharge passage 61 is connected to the maximum scroll passage portion 60*b* is also a branch point 62 at which the discharge passage 61 branches off from the scroll passage 60.

Here, when viewed in the axial direction of the rotary shaft 11, a straight line intersecting the axial line L1 of the rotary shaft 11 and passing through the branch point 62 at which the discharge passage 61 branches off from the scroll passage 60 is defined as an imaginary straight line L10. Furthermore, when viewed in the axial direction of the rotary shaft 11, a straight line intersecting the axial line L1 of the rotary shaft 11 and extending perpendicular to the imaginary straight line L10 is defined as a perpendicular line 11. The discharge passage 61 extends toward the perpendicular line L11 from the branch point 62 located on the imaginary straight line L10. The discharge passage 61 extends toward the perpendicular line L11 from the imaginary straight line L10 without cutting across the perpendicular line L11.

<Suction Chamber>

Figure 4:
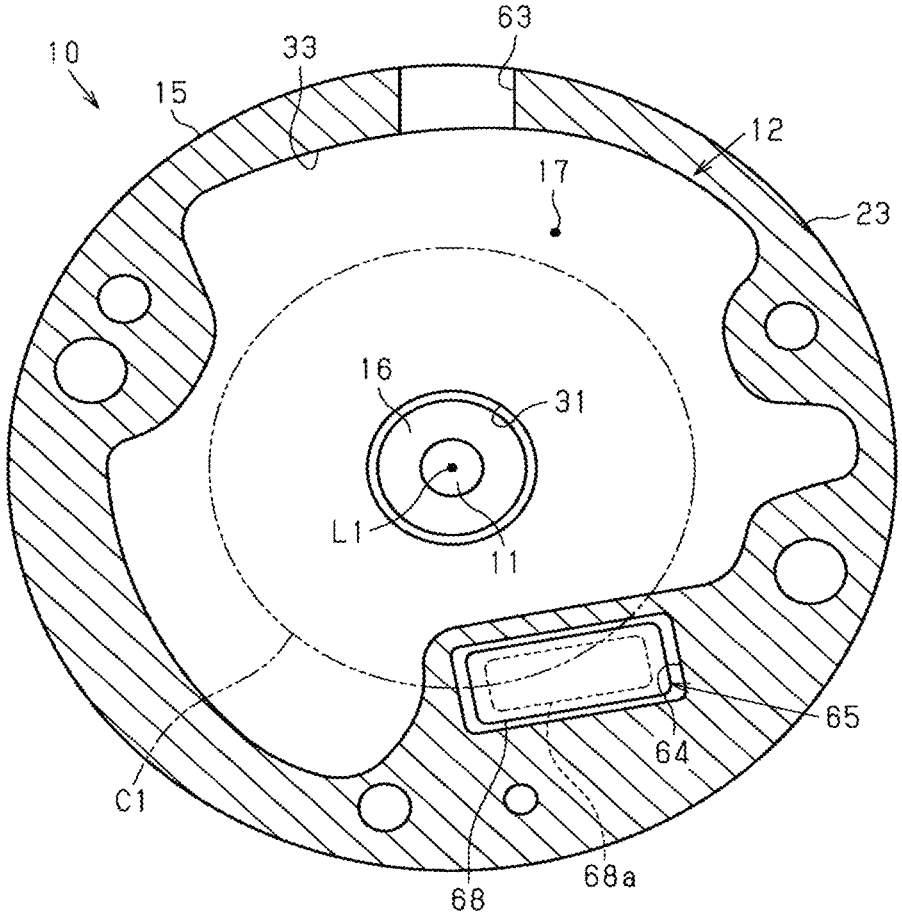
FIG. 4 is a cross-sectional view taken along a line IV-IV of FIG. 2.

As illustrated in FIGS. 3 and 4, when viewed in the axial direction of the rotary shaft 11, the suction chamber 17 is overlapped with the first impeller 16, the first diffuser 18, and the first volute 19 such that the suction chamber 17 covers them. As illustrated in FIG. 4, the centrifugal compressor 10 includes a suction passage 63. The suction passage 63 is formed in the suction housing member 23. The suction passage 63 extends in the radial direction of the rotary shaft 11. A first end of the suction passage 63 communicates with an outside of the suction housing member 23. A second end of the suction passage 63 communicates with the suction chamber 17. Thus, the suction chamber 17 and an outside of the housing 15 are connected to each other through the suction passage 63. The refrigerant outside the housing 15 is sucked into the suction chamber 17 through the suction passage 63.

<Through Hole>

As illustrated in FIG. 2, a through hole 64 is formed in the housing 15. The through hole 64 extends in the axial direction of the rotary shaft 11 to an inside of the inverter housing member 24 from the motor housing member 21 through the impeller housing member 22 and the suction housing member 23.

As illustrated in FIG. 3, the through hole 64 is formed in a rectangular hole shape. The through hole 64 is disposed away from the first volute 19. The through hole 64 is also disposed away from the suction passage 63. That is, the suction passage 63 is located away from the through hole 64 in the circumferential direction of the rotary shaft 11. The through hole 64 is disposed on an extension line of the discharge passage 61 extending in the circumferential direction of the rotary shaft 11. Note that the extension line of the discharge passage 61 extending in the circumferential direction of the rotary shaft 11 passes through an imaginary circle C1 having a point on the axial line L1 of the rotary shaft 11 as a center. When viewed in the axial direction of the rotary shaft 11, the through hole 64 is located on the same side as the discharge passage 61 with respect to the imaginary straight line L10 and adjacent to a downstream end of the discharge passage 61 in the circumferential direction of the rotary shaft 11.

<Wiring Unit>

As illustrated in FIG. 2, the centrifugal compressor 10 includes a wiring unit 65. The wiring unit 65 has a conductive member 66, a motor wire 67, and a cluster block 68. The conductive member 66 is formed in a columnar shape. The conductive member 66 is supported by the housing 15 through a supporting member 69. Specifically, the supporting member 69 is formed in a plate shape. The supporting member 69 is disposed in the inverter chamber 34. The supporting member 69 is fixed to the one end surface of the suction housing member 23, which is opposite to the other end surface of the suction housing member 23 facing the second housing member 30. The conductive member 66 is supported by the supporting member 69. A first end of the conductive member 66 is electrically connected to the inverter 14. A second end of the conductive member 66 is inserted in the through hole 64. Thus, the conductive member 66 extends from the inverter 14 into the through hole 64.

The motor wire 67 is drawn from the coil 58 of the motor 13. That is, the motor wire 67 is drawn from the motor 13. The cluster block 68 is made of resin. The cluster block 68 is formed in a rectangular box shape. A connecting terminal 68*a* is housed in the cluster block 68. The second end of the conductive member 66 is connected to the connecting terminal 68*a*. The motor wire 67 drawn from the coil 58 is also connected to the connecting terminal 68*a*. Thus, the conductive member 66 and the motor wire 67 are electrically connected to each other through the connecting terminal 68*a*.

The cluster block 68 is disposed in the through hole 64. Accordingly, the wiring unit 65 is disposed in the housing 15 and inserted in the through hole 64. Thus, the motor 13 and the inverter 14 are electrically connected to each other through the wiring unit 65. Power regulated by the inverter 14 is supplied to the coil 58 through the conductive member 66, the connecting terminal 68*a*, and the motor wire 67 to rotate the rotor 56. As a result, the rotary shaft 11 rotates integrally with the rotor 56.

<Flow of Refrigerant>

In the centrifugal compressor 10, when the rotary shaft 11 rotates, the refrigerant is sucked into the first impeller chamber 32 from the outside of the housing 15 through the suction passage 63, the suction chamber 17, and the first suction port 31 with rotation of the first impeller 16. The refrigerant sucked into the first impeller chamber 32 is sent from the first impeller chamber 32 to the first diffuser 18 by centrifugal operation with the rotation of the first impeller 16, and then, pressure of the refrigerant is increased in the first diffuser 18. After that, the refrigerant having passed through the first diffuser 18 is discharged to the first volute 19.

The refrigerant discharged to the first volute 19 flows into the motor chamber S1 through the first communication hole 50. The refrigerant in the motor chamber S1 is sucked into the second impeller chamber 38 through the second communication holes 51, the bearing accommodating chamber 35, and the second suction port 37 with rotation of the second impeller 41. The refrigerant sucked into the second impeller chamber 38 is sent to the second diffuser 46 from the second impeller chamber 38 by centrifugal operation with the rotation of the second impeller 41, and then, pressure of the refrigerant is increased in the second diffuser 46. After that, the refrigerant having passed through the second diffuser 46 is discharged to the second volute 47.

The refrigerant discharged to the second volute 47 is sucked into the third impeller chamber 40 through the third communication hole 52, the communication passage 54, and the third suction port 39 with rotation of the third impeller 42. The refrigerant sucked into the third impeller chamber 40 is sent to the third diffuser 48 from the third impeller chamber 40 by centrifugal operation with the rotation of the third impeller 42, and then, pressure of the refrigerant is increased in the third diffuser 48. After that, the refrigerant having passed through the third diffuser 48 is discharged to the third volute 49. The refrigerant discharged to the third volute 49 is discharged to the outside of the housing 15 and supplied to fuel cells.

Operation of the Embodiment

The following will describe an operation of the present embodiment.

Heat generated from the inverter 14 is dissipated to the refrigerant in the suction chamber 17 through the suction housing member 23. As a result, the inverter 14 is cooled by the refrigerant in the suction chamber 17. In addition, heat is dissipated from the refrigerant passing through the first diffuser 18 and the refrigerant discharged to the first volute 19 through the outlet of the first diffuser 18 with the rotation of the first impeller 16 to the refrigerant in the suction chamber 17. Accordingly, each of the heat of the refrigerant passing through the first diffuser 18 and the heat of the refrigerant discharged to the first volute 19 through the outlet of the first diffuser 18, with the rotation of the first impeller 16, is hardly transmitted to the inverter 14 through the suction housing member 23.

Advantageous Effect of the Embodiment

The above-described embodiment provides the following advantageous effects.

(1) The through hole 64 extends in the axial direction of the rotary shaft 11 to the inside of the inverter housing member 24 from the motor housing member 21 through the impeller housing member 22 and the suction housing member 23. The wiring unit 65 is disposed in the housing 15 and inserted in the through hole 64, and thus, the motor 13 and the inverter 14 are electrically connected to each other through the wiring unit 65 without extending the wiring unit 65 outside the housing 15. Thus, unlike in a case where the wiring unit 65 extends outside the housing 15, in the present embodiment, a seal member between the wiring unit 65 and the housing 15 is not required. Furthermore, unlike in the case where the wiring unit 65 extends outside the housing 15, in the present embodiment, the wiring unit 65 does not need to be fixed to the housing 15 such that the wiring unit 65 does not interfere with auxiliary equipment, or the like disposed around the centrifugal compressor 10. Therefore, in the present embodiment, the number of components of the centrifugal compressor 10 is not increased and ease of installation of the centrifugal compressor 10 is not reduced.

In addition, the through hole 64 is disposed away from the first volute 19, and the suction passage 63 is located away from the through hole 64 in the circumferential direction of the rotary shaft 11. With this configuration, even when the through hole 64 through which the wiring unit 65 is inserted is formed so as to extend through the impeller housing member 22 and the suction housing member 23 in the axial direction of the rotary shaft 11, the through hole 64 does not affect design of each of the first volute 19 and the suction passage 63 that are the existing configuration. Accordingly, in order to form the through hole 64 so as to extend through the impeller housing member 22 and the suction housing member 23 in the axial direction of the rotary shaft 11, for example, positions of the first volute 19 and the suction passage 63 do not need to be changed. Thus, it is prevented that the centrifugal compressor 10 is increased in size by changing the positions of the first volute 19 and the suction passage 63. Therefore, the motor 13 and the inverter 14 are electrically connected to each other without increasing the number of components and reducing the ease of installation of the centrifugal compressor 10 while the centrifugal compressor 10 is prevented from increasing in size.

(2) The through hole 64 is disposed on the extension line of the discharge passage 61 extending in the circumferential direction of the rotary shaft 11. This prevents the centrifugal compressor 10 from increasing in size as compared with a case where, for example, the through hole 64 is disposed outward with respect to the extension line of the discharge passage 61 extending in the circumferential direction of the rotary shaft 11 in the radial direction of the rotary shaft 11. Accordingly, the motor 13 and the inverter 14 are electrically connected to each other without increasing the number of components and reducing the ease of installation of the centrifugal compressor 10 while the centrifugal compressor 10 is prevented from increasing in size.

(3) When viewed in the axial direction of the rotary shaft 11, a portion of the impeller housing member 22 that is located on the same side as the discharge passage 61 with respect to the imaginary straight line L10 and adjacent to the downstream end of the discharge passage 61 in the circumferential direction of the rotary shaft 11 is a dead space. Here, when viewed in the axial direction of the rotary shaft 11, the through hole 64 is located on the same side as the discharge passage 61 with respect to the imaginary straight line L10 and adjacent to the downstream end of the discharge passage 61 in the circumferential direction of the rotary shaft 11. Accordingly, the dead space of the impeller housing member 22 is effectively used as a space where the through hole 64 is formed. Thus, there is no need to separately provide a space where the through hole 64 is formed in the impeller housing member 22, and thus, it is prevented that the centrifugal compressor 10 is increased in size by forming the through hole 64.

(4) When viewed in the axial direction of the rotary shaft 11, the suction chamber 17 is overlapped with the first impeller 16, the first diffuser 18, and the first volute 19 such that the suction chamber 17 covers them. With this configuration, heat is easily dissipated from the refrigerant passing through the first diffuser 18 and the refrigerant discharged to the first volute 19 through the outlet of the first diffuser 18 with the rotation of the first impeller 16 to the refrigerant in the suction chamber 17. Accordingly, each of the heat of the refrigerant passing through the first diffuser 18 and the heat of the refrigerant discharged to the first volute 19 through the outlet of the first diffuser 18, with the rotation of the first impeller 16, is hardly transmitted to the inverter 14 through the housing 15. As a result, the reliability of the inverter 14 is improved. Furthermore, volume of the suction chamber 17 is made as large as possible, and thus, pulsations of the refrigerant sucked into the suction chamber 17 are reduced.

(5) The cluster block 68 is disposed in the through hole 64. With this configuration, the through hole 64 is effectively used as a space where the cluster block 68 being the existing configuration is disposed. Accordingly, there is no need to separately provide a space where the cluster block 68 is disposed, so that the size of the centrifugal compressor 10 is reduced.

Modification

The above-described embodiment may be modified as follows. The above-described embodiment and the following modifications may be combined with each other as long as they do not technically contradict each other.

In the embodiment, the through hole 64 may be located, for example, outward with respect to the extension line of the discharge passage 61 extending in the circumferential direction of the rotary shaft 11 in the radial direction of the rotary shaft 11.

In the embodiment, when viewed in the axial direction of the rotary shaft 11, the through hole 64 may be located on the opposite side to the discharge passage 61 across the imaginary straight line L10.

In the embodiment, when viewed in the axial direction of the rotary shaft 11, for example, the suction chamber 17 does not need to cover a part of the first volute 19 and to be overlapped with the part of the first volute 19.

In the embodiment, when viewed in the axial direction of the rotary shaft 11, for example, the suction chamber 17 does not need to cover a part of the first diffuser 18 and to be overlapped with the part of the first diffuser 18.

In the embodiment, the cluster block 68 does not need to be disposed in the through hole 64, and may be disposed, for example, in the motor chamber S1. Even in this case, the conductive member 66 is inserted in the through hole 64. After all, the wiring unit 65 only needs to be inserted in the through hole 64.

In the embodiment, the centrifugal compressor 10 may have a configuration not including the third impeller 42.

In the embodiment, the centrifugal compressor 10 may have a configuration not including the second impeller 41 and the third impeller 42.

In the embodiment, the fluid to be compressed with the rotation of each of the first impeller 16, the second impeller 41, and the third impeller 42 is not limited to the refrigerant. Accordingly, any object to which the centrifugal compressor 10 is applied and any fluid to be compressed by the centrifugal compressor 10 may be used. For example, the centrifugal compressor 10 may be mounted on a fuel cell vehicle. In the fuel cell vehicle, a fuel cell system that supplies oxygen and hydrogen to a fuel cell to generate electricity is mounted on the fuel cell vehicle. Then, the centrifugal compressor compresses air as the fluid that includes oxygen to be supplied to the fuel cell vehicle. Furthermore, for example, the centrifugal compressor 10 may be applied to a refrigerant circuit for adjusting a temperature of a battery. In addition, an object on which the centrifugal compressor 10 is mounted is not limited to the vehicle and any object may be used.

SUPPLEMENTARY NOTES

The following will describe technical ideas obtained from the above-described embodiments and the modifications.

Supplementary Note 1

A centrifugal compressor comprising:
- a rotary shaft,
- a compression mechanism that compresses fluid with rotation of the rotary shaft;
- a motor that rotates the rotary shaft;
- an inverter that drives the motor;
- a housing in which the motor, the compression mechanism, and the inverter arranged in this order in an axial direction of the rotary shaft are accommodated; and
- a wiring unit through which the motor and the inverter are electrically connected to each other, the compression mechanism including:
- an impeller that rotates integrally with the rotary shaft;
- a suction chamber that is located closer to the inverter than the impeller in the axial direction;
- a diffuser that is disposed downstream of the impeller in a direction in which the fluid flows; and
- a volute that communicates with an outlet of the diffuser and is located outward with respect to the diffuser in a radial direction of the rotary shaft, characterized in that the housing has:
- a motor housing member in which the motor is accommodated;
- an impeller housing member in which the impeller is accommodated and that defines the diffuser and the volute;
- a suction housing member that defines the suction chamber; and an inverter housing member in which the inverter is accommodated, the motor housing member, the impeller housing member, the suction housing member, and the inverter housing member are arranged in this order in the axial direction, the housing has a through hole that extends in the axial direction to an inside of the inverter housing member from the motor housing member through the impeller housing member and the suction housing member, the wiring unit is disposed in the housing and inserted in the through hole, the through hole is disposed away from the volute, and a suction passage through which the suction chamber is connected to an outside of the housing is located away from the through hole in a circumferential direction of the rotary shaft.

Supplementary Note 2

The centrifugal compressor according to supplementary note 1, characterized in that the volute has:

a scroll passage that extends spirally around an axial line of the rotary shaft in the circumferential direction; and a discharge passage that branches off from the scroll passage, the discharge passage being located outward with respect to the scroll passage in the radial direction of the rotary shaft and extending around the axial line of the rotary shaft in the circumferential direction, and the through hole is disposed on an extension line of the discharge passage extending in the circumferential direction.

Supplementary Note 3

The centrifugal compressor according to supplementary note 2, characterized in that when viewed in the axial direction, a straight line intersecting the axial line of the rotary shaft and passing through a branch point at which the discharge passage branches off from the scroll passage is defined as an imaginary straight line, and when viewed in the axial direction, the through hole is located on the same side as the discharge passage with respect to the imaginary straight line and adjacent to a downstream end of the discharge passage in the circumferential direction.

Supplementary Note 4

The centrifugal compressor according to any one of supplementary notes 1 to 3, characterized in that when viewed in the axial direction, the suction chamber is overlapped with the impeller, the diffuser, and the volute such that the suction chamber covers the impeller, the diffuser, and the volute.

Supplementary Note 5

The centrifugal compressor according to any one of supplementary notes 1 to 4, characterized in that the wiring unit has:

a conductive member that extends from the inverter into the through hole;

a motor wire that is drawn from the motor; and a cluster block in which a connecting terminal through which the conductive member and the motor wire are electrically connected is housed, and the cluster block is disposed in the through hole.

What is claimed is:

1. A centrifugal compressor comprising:

a rotary shaft;

a compression mechanism that compresses fluid with rotation of the rotary shaft;

a motor that rotates the rotary shaft;

an inverter that drives the motor;

a housing in which the motor, the compression mechanism, and the inverter arranged in this order in an axial direction of the rotary shaft are accommodated; and a wiring unit through which the motor and the inverter are electrically connected to each other, the compression mechanism including:

an impeller that rotates integrally with the rotary shaft;

a suction chamber that is located closer to the inverter than the impeller in the axial direction;

a diffuser that is disposed downstream of the impeller in a direction in which the fluid flows; and a volute that communicates with an outlet of the diffuser and is located outward with respect to the diffuser in a radial direction of the rotary shaft, wherein the housing has:

a motor housing member in which the motor is accommodated;

an impeller housing member in which the impeller is accommodated and that defines the diffuser and the volute;

a suction housing member that defines the suction chamber; and an inverter housing member in which the inverter is accommodated, the motor housing member, the impeller housing member, the suction housing member, and the inverter housing member are arranged in this order in the axial direction, the housing has a through hole that extends in the axial direction to an inside of the inverter housing member from the motor housing member through the impeller housing member and the suction housing member, the wiring unit is disposed in the housing and inserted in the through hole, the through hole is disposed away from the volute, and a suction passage through which the suction chamber is connected to an outside of the housing is located away from the through hole in a circumferential direction of the rotary shaft.

2. The centrifugal compressor according to claim 1, wherein the volute has:

a scroll passage that extends spirally around an axial line of the rotary shaft in the circumferential direction; and a discharge passage that branches off from the scroll passage, the discharge passage being located outward with respect to the scroll passage in the radial direction of the rotary shaft and extending around the axial line of the rotary shaft in the circumferential direction, and the through hole is disposed on an extension line of the discharge passage extending in the circumferential direction.

3. The centrifugal compressor according to claim 2, wherein when viewed in the axial direction, a straight line intersecting the axial line of the rotary shaft and passing through a branch point at which the discharge passage branches off from the scroll passage is defined as an imaginary straight line, and when viewed in the axial direction, the through hole is located on the same side as the discharge passage with respect to the imaginary straight line and adjacent to a downstream end of the discharge passage in the circumferential direction.

4. The centrifugal compressor according to claim 1, wherein when viewed in the axial direction, the suction chamber is overlapped with the impeller, the diffuser, and the volute such that the suction chamber covers the impeller, the diffuser, and the volute.

5. The centrifugal compressor according to claim 1, wherein the wiring unit has:

a conductive member that extends from the inverter into the through hole;

a motor wire that is drawn from the motor; and a cluster block in which a connecting terminal through which the conductive member and the motor wire are electrically connected is housed, and the cluster block is disposed in the through hole.

* * * * *